United States Patent [19]

Bleier

[11] Patent Number: 4,610,600

[45] Date of Patent: Sep. 9, 1986

[54] ADJUSTABLE-PITCH AXIAL FAN WHEEL

[75] Inventor: Frank P. Bleier, Chicago, Ill.

[73] Assignee: Industrial Air, Inc., Amelia, Ohio

[21] Appl. No.: 742,978

[22] Filed: Jun. 10, 1985

[51] Int. Cl.[4] ..... F04D 29/36

[52] U.S. Cl. ..... 416/207; 416/93 R; 416/239; 416/248

[58] Field of Search ..... 416/207, 209, 93 R, 416/157 C, 245 B, 244 R, 234, 239, 248

[56] References Cited

U.S. PATENT DOCUMENTS

| | | | |
|---|---|---|---|
| 1,878,816 | 9/1932 | Bucklen | 416/207 |
| 2,262,695 | 11/1941 | Moeller | 416/93 R |
| 2,664,961 | 1/1954 | Goede | 416/207 |
| 3,255,827 | 6/1966 | Nichols . | |
| 3,300,123 | 1/1967 | Freyholdt et al. | 416/245 B |
| 3,323,710 | 6/1967 | Daly | 416/207 |
| 3,545,884 | 12/1970 | Schroeter et al. | 416/207 X |
| 3,957,381 | 5/1976 | Schafer | 416/244 R |
| 3,993,415 | 11/1976 | Hauser | 416/93 R |
| 4,169,693 | 10/1979 | Brubaker | 416/93 R |

FOREIGN PATENT DOCUMENTS

| | | | |
|---|---|---|---|
| 2011588 | 9/1970 | Fed. Rep. of Germany | 416/207 |
| 2523673 | 12/1976 | Fed. Rep. of Germany | 416/139 R |
| 3015208 | 11/1981 | Fed. Rep. of Germany | 416/245 B |
| 21249 | of 1903 | United Kingdom | 416/207 |

*Primary Examiner*—Everette A. Powell, Jr.
*Attorney, Agent, or Firm*—Wood, Herron & Evans

[57] ABSTRACT

An adjustable-pitch axial fan wheel. A hub has an outer surface forming a portion of a sphere. A plurality of blades are attached to the hub, each blade having a substantial flange at the base portion, the inner surface of the flange being spherical to match the surface of the hub. A central strengthening bolt extends through the blade and projects into the hub to form a pivot axis for the blade. Arcuate holes are formed in the flange, the arcuate holes being alignable with bolt holes in the hub to bolt the flange to the hub while permitting blade pitch adjustment within about 28° of rotation of each blade with respect to the hub.

4 Claims, 3 Drawing Figures

ADJUSTABLE-PITCH AXIAL FAN WHEEL

This invention relates to industrial fans having a diameter in the range of 18–84 inches, for example. The invention is particularly directed to such industrial fans having adjustable pitch blades.

An industrial fan having an adjustable pitch blade is desirable for several reasons. For example, there may be changes in the design conditions of the structure to which the fan is applied. There may be errors in the calculations of pressures as well as cubic feet per minute which must be accommodated by the adjustability of the fan. For such reasons, onsite adjustability of blade pitch is desired for some applications of industrial fans.

As will appear below, the design concepts of the present invention are also applicable to the manufacture of fans having fixed-pitch blades. The advantages of such design concepts are attainable with the additional benefit of an adjustable-pitch blade.

BACKGROUND OF THE INVENTION

An industrial fan has as its basic components the hub and a blade. Smaller fans, up to about 42 inches in diameter, can be manufactured from a single casting. It is not economically feasible, however, to manufacture larger fans from a single casting.

There have developed therefore over the years different systems for the mounting of blades to a hub. For example, in a fixed-blade fan, the blades have been welded to the hub surface. This construction requires machining of the parts, precision fixtures to hold the blades in the proper position relative to the hub during welding and the cost of the welding operation which must be performed by a skilled welder. The welded fan, as a result, is costly and labor intensive.

The larger fans are normally formed by bolting the blades to the hub, whether the fan be a fixed or adjustable-pitch-type fan. In such fans, the hub is formed with a precisely machined bore for each blade in the surface of the hub. Correspondingly, each blade has at its base a precisely machined cylindrical shank which is inserted into the bore. The fit of the shank in the bore must be held to about 0.002 inch. In a fixed-blade fan of the type described, a bolt passes through the hub and the shank to hold the blade securely on the hub. More often, the innermost portion of the shank, extending into the inside of the hub, is threaded on the outside and serves as a bolt unto which a nut is secured. In an adjustable pitch blade, the hub may be split transversely to the axis of the hub and bolted together. The faces of the two hub halves have to be machined so that they will fit against each other when closed. This is a considerable area to be machined, so this is another expensive machining operation. A set screw engages an annular groove in the shank to secure the shank and hence the blade to the hub. To vary the pitch, the hub bolts are loosened to separate the hub halves slightly. When the set screw is also loosened, the pitch of each blade can be changed. Thereafter, all bolts are tightened to secure the blade to the hub.

In fans of the type described, the bearing surface of the blade with respect to the hub is small. This results in a significant stress concentration at this annular area, thus creating the area where fatigue and failure are likely to occur.

Other forms of mounting multiple pitch blades to hubs are disclosed in U.S. Pat. Nos. 3,357,496 and 3,545,884. All of these forms of fans, including the form specifically described above, require precise machining of a bore in the hub and of the shank of the fan blade which is to be fitted in the bore.

Another form of adjustable-pitch fan is disclosed in U.S. Pat. No. 3,300,123. That patent discloses a thin-walled sheet metal blade mounted on a spherical surface of a hub. The fan of that patent does not appear to be the heavy duty industrial fan to which the present invention is directed.

SUMMARY OF THE INVENTION

The objective of the present invention has been to provide an improved industrial fan having the following advantages: adjustable pitch; simplification of the adjustment of the pitch; elimination of welding and/or machining to fit the blades to the hub; and improved operational characteristics, including the ability to be driven at at least 25,000 feet per minute tip speed without undue vibration, stress or fatigue, a high natural frequency of vibration well above the operating revolutions per second; and a low amplitude of vibration.

The foregoing advantages are attained by providing a hub, preferably cast aluminum, although it can be spun, whose outer surface is a portion of a sphere so that the base of the blade will fit against this spherical surface regardless of the blade pitch adjusted. The blades have an integrally cast flange of substantial circumferential dimension to provide a large bearing surface for the flange against the hub, the interior surface of the flange being cast as a portion of a sphere to match the outside diameter of the hub. Between the blade and the flange is a substantial fillet surrounding the blade and joining the blade to the flange. A steel strengthening bolt is cast integrally with the blade and extends into the blade up to substantially the entire length of the blade. The bolt has a threaded portion projecting inwardly from the flange and passes through a hole in the hub and is bolted to the hub. The bolt thus performs the multiple functions of strengthening the blade, forming the pivot axis for adjusting the pitch of the blade and providing, in part, the securing of the blade to the hub.

The hub has, for each blade, a pair of bolt holes. The blade flange has arcuate slots alignable with the bolt holes through which bolts are passed to secure the flange, and hence the blade, to the hub.

The hub itself can be relatively thin-walled, thereby reducing its weight, in view of the elimination of deep bores or sockets for the receipt of the blade shanks.

The fan of the foregoing description provides certain surprising results. Its performance has been outstanding. Stress tests indicate that an 80 inch diameter fan, through its present testing (short of destruction) shows none of the usual signs of fatigue. It performs as well or better than fans of conventional constructions.

The desirable operating results from the fan of the present invention are obtained with no machining required of fan or hub, thereby resulting in a significant reduction in the cost of manufacture. The structure admits of the inventorying of a small number of hubs (for example, six) and multiple blades of varying sizes resulting in many different wheel diameters with flanges formed to match the respective hub surfaces so that a wide variety of fixed or adjustable fans can be fabricated at low cost to meet a large range of industrial applications.

It is believed that the desired operational characteristics of strength, absence of fatigue, high frequency and low amplitude of vibration are attained by a combination of factors, namely, the wide flange which provides a large bearing surface between blade and hub, the generous fillet totally surrounding the blade as it joins the flange, and the strengthening center bolt.

To summarize, an adjustable industrial fan can be manufactured in a wide variety of sizes at significantly lower costs through the absence of machining while achieving improved operating characteristics as well as the capability of easily adjustable pitch.

The foregoing objectives, features and advantages of the present invention will become more readily apparent from the following detailed description taken in conjunction with the accompanying drawings in which.

Figure 1:
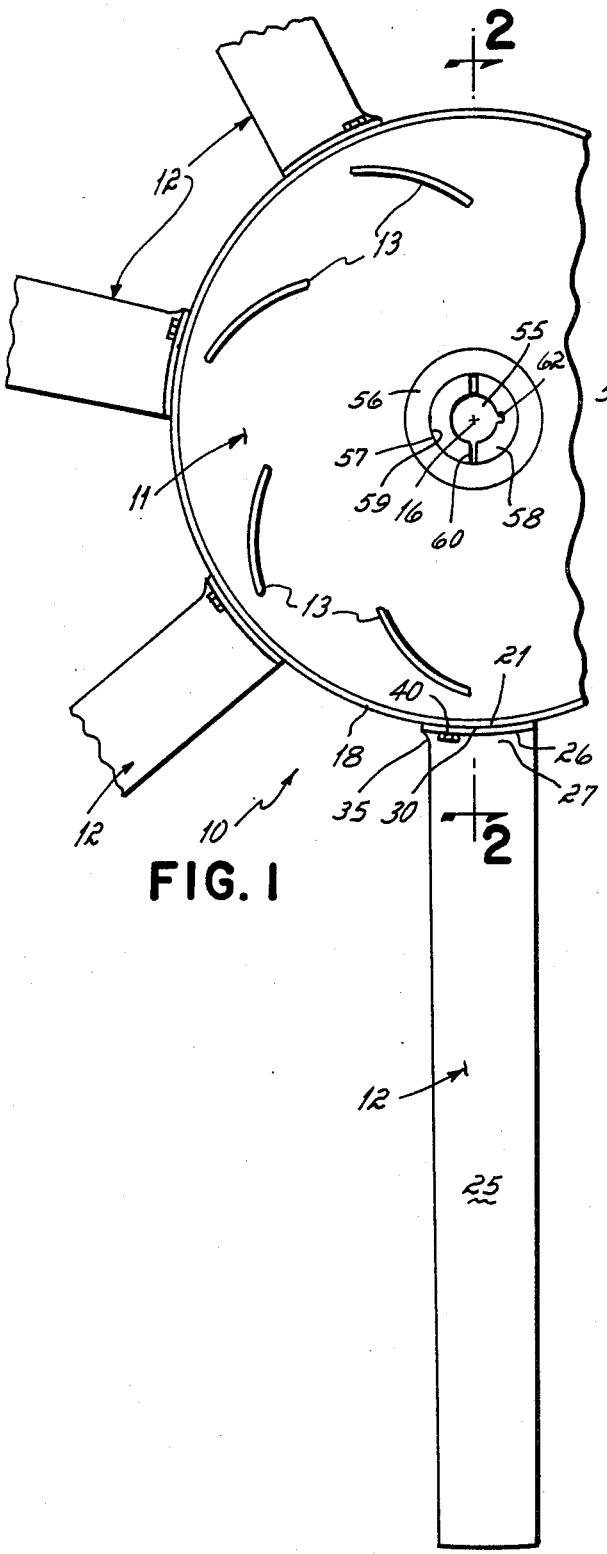
FIG. 1 is a fragmentary rear plan view of the fan constructed according to the principles of my invention.
Figure 2:
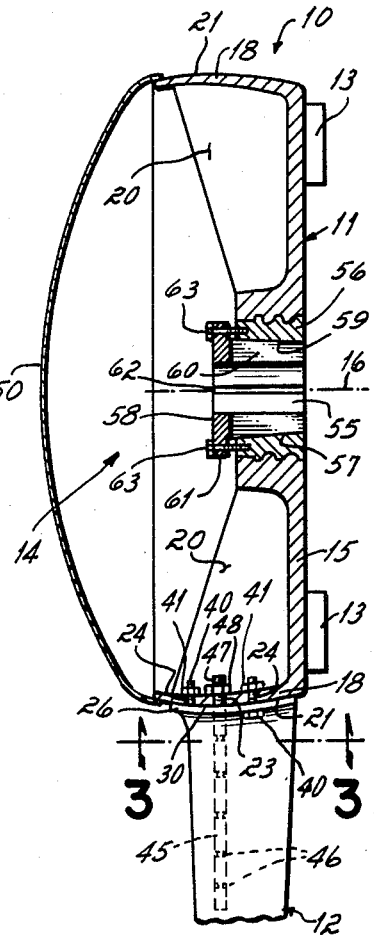
FIG. 2 is a cross-sectional view as seen on line 2—2 of FIG. 1.
Figure 3:
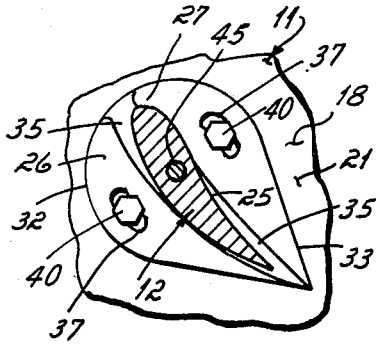
FIG. 3 is a view of the blade-mounting structure as seen on line 3—3 of FIG. 2.

Referring to FIGS. 1, 2 and 3, a fan wheel in accordance with the present invention is shown at 10. The fan to be described has an 80 inch diameter, the blades being mounted on a hub having a 30 inch diameter. It should be understood that the invention is directed to fans having a wide variety of sizes with the hub sizes ranging from about 7½ inches to 30 inches with the overall fan wheel diameter ranging from about 18 inches to 84 inches.

The fan wheel 10 includes a hub 11, fan blades 12, and scoop vanes 13 mounted on the hub. In the illustrated embodiment, seven blades 12 are equiangularly-spaced around the periphery of the hub 11, and a plurality of scoop-shaped vanes 13 are provided on the end face of the hub to cool a fan drive motor.

The hub 11 is hollow, presenting an interior chamber 14. The hub has a wall portion 15 lying in a plane perpendicular to the axis 16 of the fan. The hub also has a spherical wall portion 18 integral with the portion 15. The wall portion 15 is about ¾ inch thick and the wall portion 18 is about 11/16 inch thick, where it joins the wall portion 15, the inside of the wall portion 18 slightly tapering away from the wall portion 15, for draft in casting.

A plurality of generally triangular ribs 20 are spaced around the interior 14 of the hub to strengthen it without greatly increasing the weight of the hub. The hub wall portion 18 presents a surface 21 which is a portion of a sphere having a radius of 15 inches in the illustrated embodiment. For each blade, it has a central hole 23 and two lateral holes 24 through which bolts pass, as will be explained below.

Each blade is preferably cast aluminum with the blade angles usually decreasing from hub to tip and it includes a conventional airfoil cross section 25 at the base, integrally joined to a flange 26 at the base 27 of the blade. The flange 26 has a radially inner surface 30 which is a portion of a sphere also having a radius of 15 inches to match the radius of the surface 21 of the hub 11. The flange is about ⅜ inch to ⅝ inch thick and is partly circular, having a diameter of 5 inches or more, as indicated at 32. The remaining portion of the flange is generally triangular and projects along a line 33 a distance of about 5 inches or more. Thus, the flange is large enough to receive the entire base of the root airfoil 25. At the juncture between the airfoil 25 and the flange 26, a generous fillet 35 completely surrounds the base of the airfoil and joins the airfoil to the flange. The fillet radius is about ⅜ inch or more.

The flange has two arcuate holes 37 which are aligned with the lateral holes 24 in the hub. The length of the arcuate holes 37 is sufficient to permit the blade to be rotated with respect to the hub up to about 28°, thereby permitting the pitch of the blade to be adjusted. Bolts 40, passing through the aligned holes 24 and 37, are secured by nuts 41 to the interior of the hub, thereby clamping each blade at the predetermined pitch angle.

Each blade 12 has an elongated steel rod or bolt 45 cast integrally with the airfoil. The rod preferably has a series of annular grooves 46 spaced along its length into which the molten aluminum flows during the casting process to help secure the bolt within the airfoil blade. The bolt 45 has a threaded portion 47 projecting radially inwardly from the flange 26. That threaded portion 47 passes through the central hole 23 into the interior 14 of the hub and is secured to the hub by a nut 48, thereby accomplishing the mounting of the blade to the hub.

It has been found that by using a special type of coring even when the hub and blades are formed as sand castings, they require no finishing of the respective mating surfaces 21 and 30 in order to secure the blades to the hub and assure that the fan can operate without undue vibration even at very high tip speeds of, for example, 25,000 feet per minute. It is preferred that the respective surfaces be given a slight grinding operation to remove any burrs and the like arising from the sand casting operation.

The interior of the hub may be covered by a hood 50 which is fastened in some suitable manner to the hub.

For mounting the propeller on a motor shaft, the hub portion 15 has a central bore 55. Cast integrally with the hub is a steel inner hub 56 having a slightly tapered inner surface 57. A taper lock bushing 58 has a tapered exterior surface 59. The bushing is slotted as at 60 up to the flange 61 so that it can be compressed inwardly when drawn into the steel inner hub. The bushing has a keyway 62 which receives a key in the motor shaft (not shown). Three bolts 63 pass through the flange 61 and are threaded into the steel inner hub to draw the taper lock bushing into the hub 56, thereby causing the bushing to be squeezed down snugly upon the motor drive shaft.

This hub and lock bushing structure, while conventional, eliminates another machining operation in the construction of the fan.

It can be seen from the foregoing that the sand casting of the hub and blades with the mating outer surface of the hub and inner surface of the blade flanges, respectively, permits the fan to be constructed and assembled without any machining operations.

The flange 26 presents a considerable bearing surface against the hub, thereby eliminating an area of stress concentration. Further, the generous fillet between the innermost airfoil and the flange further eliminates areas of stress concentration. Finally, the central steel rod which may extend substantially the entire length of the airfoil blade greatly strengthens the blade, helps secure the blade to the hub, and provides the pivot axis about which the blade is rotated to adjust the pitch of the blade.

To adjust the pitch of the blade, the nut 48 on the central bolt 45 is loosened and the nuts 41 on the bolts 40 are loosened. The blade is rotated to the desired angle and all three nuts are tightened on their respective bolts.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A fan having a large hub and adapted for heavy duty industrial use and operating at tip speeds up to 25,000 feet per minute, the pitch of the blades of the fan being adjustable, comprising:

a cast aluminum hub presenting an outer surface which is a portion of a sphere;

a plurality of cast aluminum or other fan blades spaced around said hub;

each said fan blade including an integrally cast airfoil and flange at the inner end of said airfoil, said flange projecting circumferentially well beyond said airfoil blade and having an inner surface which is a portion of a sphere whose diameter is that of the outer surface of said hub;

a generous, integrally cast fillet surrounding the base of said airfoil where it is joined to said flange;

a steel bolt extending radially substantially the entire length of said airfoil blade, said blade being cast around said bolt, said bolt having a threaded portion projecting inwardly from said flange;

said hub having a central hole and two lateral holes for each blade;

said flange of each blade having two arcuate holes aligned with respective lateral holes in said hub;

said threaded portion of said bolt passing through said central hole and being secured to said hub by a nut;

and bolts passing through said aligned holes to secure said flange to said hub;

whereby the pitch angle may be changed by rotating said blade about said bolts within the limits permitted by said arcuate slots.

2. A fan as in claim 1 in which said hub is hollow and has a circumferential wall forming said spherical surface which is no thicker than about twice the thickness of said blade flange;

and a plurality of ribs extending from the central portion of said hub to said circumferential wall to strengthen said hub.

3. A fan as in claim 1 in which said hub and blade are cast aluminum members, the mating surfaces of said hub and blade flange being free of machining.

4. A fan as in claim 1 in which the central portion of said hub has an inner steel hub cast integrally thereto, said inner hub having a tapered inner bore;

a split taper lock bushing inserted in said inner bore;

bolts drawing said bushing axially with respect to said inner hub to squeeze said bushing radially against a drive shaft;

whereby the hub is provided with means free of machining the hub for attaching the hub to a shaft.

* * * * *